United States Patent [19]

Schwartz

[11] Patent Number: 4,839,262

[45] Date of Patent: Jun. 13, 1989

[54] BLEACH-ACCELERATING COMPOSITIONS COMPRISING SORBITAN ESTER COMPOUNDS AND USE THEREOF IN PHOTOGRAPHIC COLOR PROCESSING

[75] Inventor: Paul A. Schwartz, Webster, N.Y.

[73] Assignee: Eastman Kodak Company, Rochester, N.Y.

[21] Appl. No.: 162,437

[22] Filed: Mar. 1, 1988

[51] Int. Cl.[4] ..... G03C 5/50; G03C 5/44

[52] U.S. Cl. ..... 430/379; 430/393; 430/407; 430/430; 430/461; 430/493

[58] Field of Search ..... 430/379, 393, 407, 430, 430/461, 493; 252/174.21, 142, 151, DIG. 1

[56] References Cited

U.S. PATENT DOCUMENTS

| | | | |
|---|---|---|---|
| 3,893,858 | 12/1975 | Wabnitz | 96/60 R |
| 4,059,446 | 7/1977 | Hazenbosch et al. | 96/50 R |
| 4,322,493 | 3/1982 | Shibaoka et al. | 430/407 |
| 4,590,150 | 5/1986 | Fujita | 430/393 |
| 4,604,525 | 8/1986 | Kitada et al. | 252/DIG. 1 |

FOREIGN PATENT DOCUMENTS 1138842 3/1969 United Kingdom .

OTHER PUBLICATIONS

Foster Dee Snell, "Surface-Achis Agents", pp. 107-130, 1943.

McCutcheon's, "Detergents and Emulsifiers", p. 245, 1970.

McCutcheon's, "Functional Materials", p. 162, 1980.

M. R. Murray et al., "Conditioning Baths for Use in Photographic Processing", Research Disclosure; vol. 191, Item 19104, Mar., 1980.

*Primary Examiner*—Paul R. Michl

*Assistant Examiner*—Patrick Doody

*Attorney, Agent, or Firm*—Alfred P. Lorenzo

[57] ABSTRACT

Improved bleach-accelerating compositions that are especially useful in the reversal color processing of photographic elements are comprised of a bleach-accelerating agent and an ethyleneoxy-substituted fatty acid ester of sorbitan. The bleach-accelerating composition is utilized subsequent to the color developing step and prior to the bleaching step and serves to enhance the effectiveness of the bleaching step. Incorporation of the ethyleneoxy-substituted fatty acid ester of sorbitan in the bleach-accelerating composition serves to avoid or at least minimize problems of scum formation which commonly occur in such compositions.

20 Claims, No Drawings

BLEACH-ACCELERATING COMPOSITIONS COMPRISING SORBITAN ESTER COMPOUNDS AND USE THEREOF IN PHOTOGRAPHIC COLOR PROCESSING

FIELD OF THE INVENTION

This invention relates in general to color photography and in particular to methods and compositions for use in the processing of color reversal photographic elements. More specifically, this invention relates to an improved bleach-accelerating composition for use in photographic color reversal processing, which provides effective acceleration of bleaching activity while avoiding or minimizing the problem of scum formation.

BACKGROUND OF THE INVENTION

Multicolor, multilayer photographic elements are well known in the art of color photography. Usually, these photographic elements have three different selectively sensitized silver halide emulsion layers coated on one side of a single support. The vehicle used for these emulsion layers is normally a hydrophilic colloid, such as gelatin. One emulsion layer is blue-sensitive, another green-sensitive and another red-sensitive. Although these layers can be arranged on a support in any order, they are most commonly arranged with the support coated in succession with the red-sensitized layer, the green-sensitized layer and the blue-sensitized layer (advantageously with a bleachable blue light-absorbing filter layer between the blue-sensitive layer and the green-sensitized layer) or with the opposite arrangement and no filter layer. Colored photographic images are formed from latent images in the silver halide emulsion layers during color development by the coupling of oxidized aromatic primary amine color developing agent with couplers present either in the color developer solution or incorporated in the appropriate light-sensitive layers. Color photographic elements containing dye images usually utilize a phenolic or naphtholic coupler that forms a cyan dye in the red-sensitized emulsion layer, a pyrazolone or cyanoacetyl derivative coupler that forms a magenta dye in the green-sensitized emulsion layer and an acetylamide coupler that forms a yellow dye in the blue-sensitive emulsion layer. Diffusible couplers are used in color developer solutions. Nondiffusing couplers are incorporated in photographic emulsion layers. When the dye image formed is to be used in situ, couplers are selected which form non-diffusing dyes. For image transfer color processes, couplers are used which will produce diffusible dyes capable of being mordanted or fixed in the receiving sheet.

In the production of color photographic images, it is necessary to remove the silver image which is formed coincident with the dye image. This can be done by oxidizing the silver by means of a suitable oxidizing agent, commonly referred to as a bleaching agent, in the presence of halide ion; followed by dissolving the silver halide so formed in a silver halide solvent, commonly referred to as a fixing agent. Alternatively, the bleaching agent and fixing agent can be combined in a bleach-fixing solution and the silver removed in one step by use of such solution.

A commercially important process intended for use with color reversal photographic elements which contain the couplers in the silver halide emulsion layers, or in layers contiguous thereto, utilizes, in order, the following processing baths: first developer, wash, reversal bath, color developer, bleach, fix, wash and stabilizer. In this process, the first developer reduces the exposed silver halide to metallic silver; the reversal bath nucleates the silver halide that remains after first development, the color developer converts the nucleated silver halide to metallic silver and forms the dye images, the bleach converts all metallic silver to silver halide, the fix converts the silver halide into soluble silver complexes that are washed from the element, and the stabilizing bath improves image dye stability.

In one particularly advantageous form of the aforesaid color reversal process, a bleach-accelerating bath is employed between the color developing bath and the bleaching bath. Such a bleach-accelerating bath is also referred to in the photographic field as a "conditioning bath". It is used to "condition" the metallic silver, developed in the first and color developers, for complete oxidation to silver halide and to help preserve the acidity of the bleach solution by reducing carryover of color developer into the bleach. The conditioning bath contains, as an essential ingredient, an effective amount of a bleach-accelerating agent. This agent is imbibed into the emulsion layers of the photographic element during treatment with the conditioning bath and, accordingly, is present to exert its beneficial influence in situ when the photographic element enters the subsequent bleach bath.

A wide variety of effective bleach-accelerating agents are well known in the art of photographic color processing. Examples of particularly effective bleach-accelerating agents include aliphatic thiols, heterocyclic thiols, disulfides, thioethers, and persulfates. References describing specific agents which exibit very effective bleach-accelerating capabilities include British Patent No. 1,138,842 published Jan. 1, 1969 and U.S. Patent No. 3,893,858 issued July 8, 1975.

In carrying out the aforesaid color reversal process with the aid of a conditioning bath, a serious problem that is frequently encountered is deposition of scum on the photographic element as it is contacted with the conditioning bath. Formation of precipitates within the conditioning bath and deposition of such material on the walls of the conditioning bath tank is also a problem, but it is the formation of an adherent layer of scum on the photographic element itself that is of greatest concern. A number of factors are believed to influence such scum formation. For example, the formation of scum is significantly influenced by the extent of seasoning that has taken place in the process. Seasoning products released from the emulsion layers, or other layers, of the photographic element tend to build up in the processing baths. One seasoning product which is believed to be a significant source of scum formation is the coupling-off group 4-hydroxyphenyl—4'—phenylmethoxyphenyl sulfone. This anionic group is derived from a yellow coupler that is commonly used in color reversal films. In addition to the extent of seasoning, another feature which influences scum formation is the extent to which the photographic element comes into contact with transport rollers during processing. Such rollers tend to serve as places where scum-forming materials can accumulate and, by contact with the photographic element, may make it more susceptible to the deposition of scum.

Photographic films which are processed by color reversal processing methods often include an antistatic layer on the side of the film opposite to the emulsion layers. Antistatic layers which are of particular commercial importance include those described in Kelley et al, U.S. Pat. No. 4,070,189 issued Jan. 24, 1978. As described in this patent, the antistatic compositions comprise a highly cross-linked vinylbenzyl quaternary ammonium polymer and a hydrophobic binder. Reversal films containing such antistatic layers are especially prone to scum formation. Deposition of the layer of scum takes place primarily on the base side of the film; apparently influenced, at least in part, by attraction between cationic groups in the antistatic layer and anionic seasoning products carried into the conditioning bath.

While scum can form in any of a variety of photographic processing baths, the problem of scum formation is particularly acute in the above-described bleach-accelerating or conditioning baths. Overcoming this problem has proved to be a particularly formidable task. Attempts have been made to solve the problem through incorporation in the conditioning bath of certain non-ionic surfactants as described, for example, in an article entitled "Conditioning Baths For Use In Photographic Processing", published in Research Disclosure, Vol. 191, Item 19104, March, 1980. However, addition of agents to the bleach-accelerating bath which might serve to inhibit scum formation is severely inhibited by the requirements that the agent employed not only be free of adverse effects on the sensitometry of the photographic film, but also that it not inhibit or detract from the bleach-accelerating capability of the bleach-accelerating agent and that it be fully compatible with concentrated forms of the bleach-accelerating bath in order to facilitate packaging, shipping and handling.

It is toward the objective of providing an improved bleach-accelerating composition which does an effective job of accelerating the bleaching action of the subsequently utilized bleaching agent, and which eliminates or at least reduces the deposition of scum in the bleach-accelerating bath, that the present invention is directed.

SUMMARY OF THE INVENTION

In accordance with this invention, it has been discovered that ethyleneoxy-substituted fatty acid esters of sorbitan are highly effective as scum preventing agents in bleach-accelerating compositions. Thus, the improved bleach-accelerating compositions of this invention, which are especially useful in color reversal photographic processing, are comprised of an effective amount of bleach-accelerating agent and a scum-preventing amount of an ethyleneoxy-substituted fatty acid ester of sorbitan. In a particularly preferred embodiment of this invention, the ethyleneoxy-substituted fatty acid ester of sorbitan has a hydrophile-lipophile balance value of at least about fifteen.

The present invention also provides an improved method of photographic processing including the steps of treating a photographic element, in succession, with a color developing composition, a bleach-accelerating composition, and a bleaching composition in which the bleach-accelerating composition comprises a bleach-accelerating agent and, in an amount sufficient to prevent scum formation, an ethyleneoxy-substituted fatty acid ester of sorbitan.

In a particularly preferred embodiment of the method of this invention, a photographic element comprising an antistatic layer containing a highly cross-linked vinylbenzyl quaternary ammonium polymer and a hydrophobic binder is processed by a method including the steps of treating, in succession, with a color developing composition, a bleach-accelerating composition and a bleaching composition, wherein the bleach-accelerating composition contains a scum-preventing amount of an ethyleneoxy-substituted fatty acid ester of sorbitan.

DESCRIPTION OF THE PREFERRED EMBODIMENTS

Any of a wide variety of photographic elements can be advantageously processed with the aid of the improved bleach-accelerating compositions of this invention. For a detailed description of useful photographic elements and methods for their manufacture, reference can be made to Research Disclosure, Item 17643, Vol. 176, December, 1978. published by Industrial Opportunities Ltd., Havant Hampshire, P091EF, United Kingdom.

Color reversal photographic elements utilized in the practic of this invention are comprised of a support having on one side thereof a plurality of photosensitive silver halide emulsion layers. The photosensitive layers can contain any of the conventional silver halides as the photo-sensitive material, for example, silver chloride, silver bromide, silver bromoiodide, silver chlorobromide, silver chloroiodide, silver chlorobromoiodide, and mixtures thereof. Useful support materials include cellulose acetate film, polyvinylacetal film, polycarbonate film, polystyrene film, polyethylene terephthalate film, and the like. The silver halide is dispersed within a suitable hydrophilic colloid such as gelatin or derivatives thereof. The silver halide emulsion layers can contain a variety of well known addenda, including such agents as chemical sensitizers, development modifiers, antifoggants, and the like.

As explained hereinabove, color reversal photographic films often include an antistatic layer, and a preferred layer for this purpose is one containing a highly cross-linked vinylbenzyl quaternary ammonium polymer in combination with a hydrophobic binder. The weight ratio of binder to vinylbenzyl quaternary ammonium polymer is typically in the range of from about 10:1 to 1:1 and more preferably from about 5:1 to 2:1. Useful hydrophobic binders include acetylated cellulose, polymethyl methacrylate, polyethyl acrylate, polystyrene, poly [butylmethacrylate-co-styrene](60:40), polyvinyl acetal, cellulose acetate butyrate, and the like. Examples of preferred vinylbenzyl quaternary ammonium polymers include copoly [N-vinylbenzyl—N,N,N-trimethylammonium chloride-co-ethylene glycol dimethacrylate](93:7); copoly]N-vinylbenzyl-N,N,N-trimethylammonium chloride-co-ethylene glycol diacrylate](90:10); copoly[N-vinylbenzyl-N,N,N-triethylammonium chloride-co-ethylene glycol dimethacrylate](93:7); and copoly[styrene-co-N-vinylbenzyl-N,N,N-trimethylammonium chloride-co-divinylbenzene](20:70:10).

As also explained hereinabove, a preferred color reversal process utilizes a first developer, a reversal bath, a color developer, a bleach-accelerating bath, a bleach bath, a fix and a stabilizer. The components that are useful in such baths are well known in the photographic art.

The first developer contains a black-and-white developing agent or a mixture of such developing agents. Useful developing agents include dihydroxybenzene developing agents such as hydroquinone, 3-pyrazolidone developing agents such as 1-phenyl-3-pyrazolidone, and aminophenol developing agents such as paraaminophenol. In addition to the developing agent, the first developer typically contains other agents such as preservatives, sequestering agents, restrainers, antifoggants, buffers and silver halide solvents.

The reversal bath contains a nucleating agent, usually a boron compound or a chelated stannous salt that functions as a reducing agent, as well as antioxidants, buffers, fungicides and sequestering agents.

In addition to an aromatic primary amino color developing agent, the color developing bath typically contains sequestering agents, buffering agents, preservatives, competing couplers and silver halide solvents.

Particularly useful aromatic primary amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include:

N,N-diethyl-p-phenylenediamine monohydrochloride,
4-N,N-diethyl-2-methylphenylenediamine monohydrochloride
4-(N-ethyl-N-2-methanesulfonylaminoethyl)-2-methylphenylenediamine sesquisulfate monohydrate,
4-(N-ethyl-N-2-hydroxyethyl)-2-methylphenylenediamine sulfate,
4-N,N-diethyl-2,2'-methanesulfonylaminoethylphenylenediamine hydrochloride, and the like.

The essential component of the bleaching bath is the bleaching agent which converts metallic silver to silver ions. Other common components of the bleaching bath include halides, sequestering agents and corrosion inhibitors. Ammonium or alkali metal salts of a ferric complex of an aminopolycarboxylic acid are particularly useful as bleaching agents. Also of particular utility are the persulfate bleaching agents such as ammonium persulfate or an alkali metal persulfate.

Bleaching agents can be used individually or in the form of mixtures of two or more bleaching agents. Exemplary bleaching agents of the aminopolycarboxylic acid type, which can be used alone or in the form of mixtures, include ferric complexes of:

nitrilotriacetic acid,
ethylenediamine tetraacetic acid,
1,3-propylenediamine tetraacetic acid,
diethylenetriamine pentaacetic acid,
ortho-diamine cyclohexane tetraacetic acid,
ethylene glycol bis(aminoethyl ether) tetraacetic acid,
diaminopropanol tetraacetic acid,
N-(2-hydroxyethyl)ethylenediamine triacetic acid,
ethyliminodipropionic acid,
iminodiacetic acid,
methyliminodiacetic acid,
ethyliminodiacetic acid, and the like.

The fixing bath converts all silver halide into soluble silver complexes which diffuse out of the emulsion layers. Fixing bath retained within the layers of the photographic element is removed in a subsequent water washing step. Thiosulfates, including ammonium thiosulfate and alkali metal thiosulfates such as sodium thiosulfate and potassium thiosulfate, are particularly useful as fixing agents. Other components of the fixing bath include preservatives and sequestering agents.

The final bath typically used in processing reversal color films is a stabilizing bath which contains a dye stabilizing agent, such as formaldehyde, and a wetting agent.

A wide variety of different color reversal processes are well known in the art. For example, a single color developing step can be used when the coupling agents are incorporated in the photographic element of three separate color developing steps can be used in which coupling agents are included in the developing solutions. The reversal step can be carried out by use of a reversal bath, or by a re-exposure step, or by incorporating a fogging agent in the color developing bath. In order to provide shorter processing times, bleaching and fixing can be combined in a single step and stabilizing can be omitted.

The present invention is particularly concerned with improvement in the performance of the bleach-accelerating bath and especially with alleviating the problem of scum formation that commonly occurs in this bath. In addition to the bleach-accelerating agent, the bleach-accelerating bath typically contains a preservative, for example, an alkali metal sulfite, and a sequestering agent, for example, ethylenediaminetetraacetic acid, which prevents the formation of iron stain in the emulsion layers.

The bleach-accelerating baths of this invention are aqueous acidic solutions typically having a pH in the range of from about 4.5 to about 6.5. They contain a bleach-accelerating agent, which is typically present in an amount of from about 0.1 to about 20 grams per liter of solution and more preferably in an amount of from about 0.4 to about 2 grams per liter. They also contain an ethyleneoxy-substituted fatty acid ester of sorbitan, which is typically present in an amount of from about 0.1 to about 20 grams per liter of solution and more preferably in an amount of from about 1 to about 3 grams per liter.

Sulfur-containing organic compounds are most frequently utilized as bleach-accelerating agents in photographic color processing. However, other types of bleach-accelerating agents are also known including the polyalkylene oxides of U.S. Pat. No. 3,241,966, the organic amines of U.S. Pat. No. 3,707,374, the onium compounds of U.S. Pat. No. 3,748,136 and the n-hexoxyethanol of U.S. Pat. No. 3,042,520. Patents describing the use of various sulfur-containing organic compounds as bleach-accelerating agents include U.S. Pat. Nos. 3,617,283, 3,772,020, 3,809,563, 3,893,858 and 4,144,068 and British Pat. Nos. 1 138 842 and 1 374 359.Use of a persulfate to accelerate the bleaching activity of a bleaching bath, containing a ferric complex of an aminopolycarboxylic acid as a bleaching agent, is described in Research Disclosure, Vol. 207, Item 20744, July, 1981.

Use of thiols and of metal complexes such as the bipyridine complexes of cobalt, to accelerate the bleaching activity of persulfate bleaching agents is described in Research Disclosure, Vol. 157, Item 15704, May, 1977. Use of a heavy metal sequestering agent to improve the stability of bleach-accelerating baths containing a thiol is described in Research Disclosure, Vol. 201, Item 20111, January, 1981.

Sulfur-containing organic compounds which are preferred for use as bleaching-accelerating agents in this invention include heterocyclic thiols such as aminothiadiazolethiol, mercaptotriazole, imidazolethiol and aminomercaptotriazole; disulfides such as bis(2-aminoethane)disulfide, thioglycerol disulfide and bis(N,N-dimethyl-2-aminoethane)disulfide; and thioethers such as dithiaoctanediol and thiadiethanol. Especially preferred are aliphatic thiols of the formula:

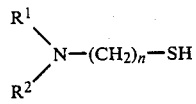

where each of $R^1$ and $R^2$ is H, $CH_3$ or $C_2H_5$ and n is an integer having a value of from 1 to 3. Specific examples of such aliphatic thiols include 2-aminoethanethiol, 3-aminopropanethiol, dimethylaminoethanethiol, N-methyl-N-ethyl-aminoethanethiol and diethylaminoethanethiol.

The most preferred bleach-accelerating agent for the purpose of this invention is monothioglycerol.

Bleach-accelerating baths used heretofore have been particularly susceptible to scum formation. Thus, for example, seasoning products are leached from the photographic element into the color developing solution and, because this solution is strongly alkaline, such products tend to remain in solution so that there is usually not a serious problem of scum formation in the color developing solution. However, when such products are carried by the photographic element into the bleach-accelerating bath they encounter an acidic environment and are likely to precipitate out of solution, forming crystalline deposits on the walls of the processing tank and on the transport rollers and forming a layer of scum on the photographic element.

In accordance with this invention, the scum formation is avoided, or at least significantly reduced, by incorporating in the bleach-accelerating bath an effective amount of an ethyleneoxy-substituted fatty acid ester of sorbitan. These esters can be prepared by reacting sorbitan with a fatty acid to form the corresponding fatty acid ester and reacting the fatty acid ester with ethylene oxide, typically in an amount of about 2 to 50 moles and preferably 4 to 20 moles of ethylene oxide per mole of sorbitan. The ethyleneoxy-substituted fatty acid esters of sorbitan which are useful in this invention are those which are substantially miscible with aqueous media.

The ethyleneoxy-substituted fatty acid esters of sorbitan are well known commercially available nonionic surfactants and are sold under the trademark TWEEN by ICI Americas Inc. Surfactants that are commercially available under this trademark include TWEEN 20, TWEEN 21, TWEEN 40, TWEEN 60, TWEEN 61, TWEEN 65, TWEEN 80, TWEEN 81 and TWEEN 85. These surfactants are also referred to as polysorbates. Thus, TWEEN 20 can be referred to as polysorbate-20 or polyoxyethylene 20 sorbitan monolaurate and TWEEN 85 as polysorbate-85 or polyoxyethylene 20 sorbitan trioleate.

The ethyleneoxy-substituted fatty acid esters of sorbitan which are preferred for use in the present invention can be represented by the following general formula:

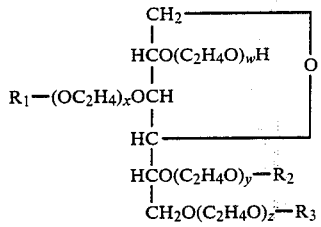

where $R_1$, $R_2$ and $R_3$ are hydrogen atoms or fatty acid radicals containing about 10 to 20 carbon atoms, such as laurate, palmitate or oleate radicals, and the sum of w+x+y+z is in the range of from about 4 to about 20.

The esters of sorbitan described above can be monoesters, diesters or triesters and their miscibility with aqueous media is dependent on the degree of esterification, the length of the fatty acid radical, and the extent of ethyleneoxy substitution. They are frequently characterized by reference to their hydrophile-lipophile balance (HLB) value. For a description of hydrophile-lipophile balance see "Emulsions", Kirk-Othmer Encyclopedia of Chemical Technology, 3rd Ed., Vol. 8, pp. 900–930, Wiley-Interscience, New York, N.Y., (1978). The higher the HLB value the greater the degree of hydrophilicity. For the purposes of this invention, it is preferred to utilize the sorbitan esters which have an HLB value of at least about fifteen. Particularly preferred for the purposes of this invention is an ethyleneoxy-substituted sorbitan monolaurate in which the sum of w+x+y+z is equal to twenty. This compound is commercially available under the trademark TWEEN 20, and has an HLB value of 16.7. It can be represented by the following formula:

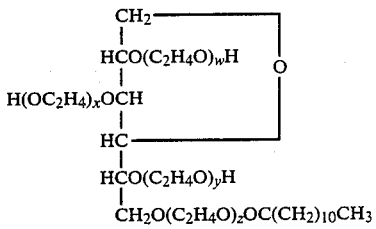

The time and temperature for treatment of the photographic element with the bleach-accelerating bath of this invention can vary widely, as desired. Typically, temperatures in the range of from about 20° C. to about 40° C. and times in the range of from about 0.5 to about 5 minutes are suitable.

The invention is further illustrated by the following examples of its practice.

EXAMPLE 1

To simulate conditions encountered when a seasoned conditioning bath comes in contact with a photographic element having cationic agents present in a surface layer, such as an antistatic layer, a test was devised making use of a water-soluble cationic surfactant. The material employed was diisobutylphenoxyethoxyethyldimethylbenzyl ammonium chloride, which is commercially available under the trademark HYAMINE 1622 from LONZA, INC. The conditioning bath employed had the following composition:

| Component | Grams/liter |
|---|---|
| Monothioglycerol | 0.5 |
| Ethylenediamine tetraacetic acid | 8.0 |
| Potassium sulfite (45% in water) | 29.1 |
| Water to one liter | |
| pH = 6.5 | |

After the conditioning bath had been fully seasoned by use in processing, a 100 milliliter sample was taken and to this sample there was added 1.0 milliliters of HYAMINE 1622 (5% solution in water) and an amount of an ethyleneoxy-substituted fatty acid ester of sorbitan as indicated in the table below. Solution clarity was then evaluated by determining percentage transmission at 670 nanometers using a Brinkman Model PC 600 Probe Colorimeter as the instrument for measuring transmission. Low percentage transmittance values correspond to a hazy solution which is indicative of interaction of the seasoning products with the cationic HYAMINE 1622. High percentage transmittance values correspond to a clear solution and are indicative of the effectiveness of the sorbitan ester in preventing such interaction and thus of preventing scum formation. Results are reported in Table I.

| No. | Surfactant | (ml/L) | w + x + y + z | $R_1$ | $R_2$ | $R_3$ | (670 nm) | HLB |
|---|---|---|---|---|---|---|---|---|
| 1 | None | — | — | — | — | — | 25 | — |
| 2 | TWEEN 20 | 0.5 | 20 | H | H | laurate | 41 | 16.7 |
| 3 | TWEEN 20 | 1.0 | 20 | H | H | laurate | 73 | 16.7 |
| 4 | TWEEN 20 | 2.0 | 20 | H | H | laurate | 98 | 16.7 |
| 5 | TWEEN 40 | 0.5 | 20 | H | H | palmitate | 48 | 15.6 |
| 6 | TWEEN 40 | 1.0 | 20 | H | H | palmitate | 70 | 15.6 |
| 7 | TWEEN 40 | 2.0 | 20 | H | H | palmitate | 96 | 15.6 |
| 8 | TWEEN 60 | 1.0 | 20 | H | H | stearate | * | 14.9 |
| 9 | TWEEN 61 | 1.0 | 4 | H | H | stearate | * | 9.6 |
| 10 | TWEEN 80 | 0.5 | 20 | H | H | oleate | 47 | 15.0 |
| 11 | TWEEN 80 | 1.0 | 20 | H | H | oleate | 65 | 15.0 |
| 12 | TWEEN 80 | 2.0 | 20 | H | H | oleate | 78 | 15.0 |
| 13 | TWEEN 21 | 1.0 | 4 | H | H | laurate | 10 | 13.3 |
| 14 | TWEEN 81 | 1.0 | 5 | H | H | oleate | 30 | 10.0 |
| 15 | TWEEN 85 | 1.0 | 20 | oleate | oleate | oleate | 10 | 11.0 |

*Meaningful percentage transmission values could not be determined in these tests because the surfactant was insoluble in the conditioning bath.

Considering the data in Table I, it is noted that excellent results were obtained with TWEEN 20, TWEEN 40 and TWEEN 80. In contrast, TWEEN 21, TWEEN 81 and TWEEN 85 did not provide similar results. It is believed that this is attributable to an inadequate degree of hydrophilicity, as evidenced by the lower HLB values of these materials, for effective performance under these specific conditions. TWEEN 60 and TWEEN 61 were not effective because the lengthy stearate radical rendered them insoluble in this particular conditioning bath. Thus, in putting this invention into practice, some routine experimentation is typically needed to select an effective sorbitan ester for the particular conditions utilized. Among the factors which influence the effectiveness of the sorbitan esters are the salt concentration and pH of the conditioning bath and the temperature employed in the conditioning step of the photographic process.

As pointed out hereinabove, the use of certain polyoxyethylene compounds in a conditioning bath to reduce scum formation has been disclosed in Research Disclosure, Vol. 191, Item 19104, March 1980. The compounds disclosed therein are represented by the general formula:

$$R-(OCH_2CH_2)_n-OH$$

where n is an integer, typically having a value in the range from about 6 to about 50, and R is an alkyl group, an alkenyl group or an alkylaryl group, preferably containing about 6 to about 30 carbon atoms. Specific examples of such compounds identified in this article are stearyl alcohol ethoxylated with 20 moles of ethylene oxide and ethoxylated nonylphenol comprising 25 ethylene oxide units. The use of similar compounds to reduce sludge formation in black-and-white photographic processing is described in U.S. Pat. No. 4,059,446, issued Nov. 22, 1977. In accordance with the disclosure of this patent, the polyoxyethylene compound is added to a fixing or washing bath.

While the polyoxyethylene compounds described in U.S. Pat. No. 4,059,446 and the aforesaid article in Research Disclosure are of some utility in reducing scum formation in a conditioning bath, they do not provide the advantageous combination of characteristics exhibited by the ethyleneoxy-substituted fatty acid esters of sorbitan. One compound of the aforesaid polyoxyethylene type which has been used heretofore in a conditioning bath employed in reversal color processing is a nonionic surfactant available from Heterene Chemical Co., Inc. under the trademark HETOXOL CS-30. This compound has the formula $CH_3(CH_2)_{15}(OCH_2CH_2)_{30}OH$. Use of HETOXOL CS-30 at a level of 0.75 ml/L in the test procedure described above was found to provide a percentage transmission at 670 nm of 90%. However, this compound is incompatible with bleach-accelerating solutions, especially in the concentrated form in which they are typically shipped and stored. It tends to degrade or decompose monothioglycerol, the most preferred bleach-accelerating agent, at an unacceptably high rate. It is believed that it generates peroxides which react quickly in a chain reaction with monothioglycerol. The compatibility problem is especially severe if it is used in the bleach-accelerating solution at high concentrations in order to process films having a high concentration of antistatic agent in the backing layer. In marked contrast, the ethyleneoxy-substituted fatty acid esters of sorbitan are fully compatible with conditioning bath concentrates and have no harmful effect on monothioglycerol or other bleach-accelerating agents.

EXAMPLE 2

A color reversal photographic film, designated herein as Film A, was processed in a continuous processor employing a conventional process utilizing a first developer, wash, reversal bath, color developer, conditioning bath, bleach, fix, wash and stabilizer. The film included an antistatic layer containing the antistatic agent copoly[N-vinylbenzyl-N,N,N-trimethylammonium chlorideco-ethylene glycol dimethacrylate] (93:7) in an amount of 75 mg/m$^2$. Two additional films, designated herein as Film B and Film C, which were identical to Film A except that Film B contained the antistatic agent at a level of 130 mg/m$^2$ and Film C at a level of 185 mg/m$^2$, were processed in the same process under the same conditions. In a control test, the conditioning bath had the following composition:

| Compound | Grams/liter |
|---|---|
| Monothioglycerol | 0.5 |
| Ethylenediamine tetraacetic acid | 8.0 |
| Potassium sulfite (45% in water) | 29.1 |
| Water to one liter | |
| pH = 6.5 | |

To evaluate the effect of an ethyleneoxy-substituted fatty acid ester of sorbitan on scum formation, each of Films A, B and C was processed in a series of tests in which TWEEN 20 was added to the conditioning bath in controlled increments and the processed film was inspected visually for the presence of scum on the base side. The results obtained are reported in Table II below.

TABLE II

| Test No. | Concentration of Surfactant (ml/L) | Film A | Film B | Film C |
|---|---|---|---|---|
| Control | 0 | scum | scum | scum |
| 1 | 0.2 | clean | scum | scum |
| 2 | 0.4 | clean | scum | scum |
| 3 | 0.6 | clean | scum | scum |
| 4 | 0.8 | clean | scum | scum |
| 5 | 1.0 | clean | scum | scum |
| 6 | 1.2 | clean | scum | scum |
| 7 | 1.4 | clean | clean | scum |
| 8 | 1.6 | clean | clean | scum |
| 9 | 1.8 | clean | clean | scum |
| 10 | 2.0 | clean | clean | scum |
| 11 | 5.0 | clean | clean | scum |

Considering the data in Table II, it is noted that when no surfactant was used, scum was formed with all three films. Use of the TWEEN 20 surfactant in adequate amounts, avoided the formation of scum, except with the film containing the highest level of the antistatic agent.

The present invention can be advantageously employed in any photographic process in which the photographic element is treated with a conditioning bath subsequent to color development and prior to bleaching or bleach-fixing. It provides very significant benefits. For example, the photographic element processed with the benefit of the invention is much cleaner and the formation of unwanted precipitates in processing tanks and equipment is greatly reduced. The invention can be effectively employed to extend the useful life of a conditioning bath, since it permits an increased accumulation of seasoning products to be tolerated. The invention is of particular benefit in processing photographic films which have an antistatic layer on the base side. Thus, for example, it permits the resistance to abrasion and scratching of the antistatic layer to be increased by increasing the coverage of hydophobic binder in the layer. This typically requires a corresponding increase in coverage of antistatic agent in the layer to maintain the desired conductivity, but such increase can be tolerated without risk of excessive scum formation by use of the improved conditioning bath of this invention.

The invention has been described in detail with particular reference to preferred embodiments thereof, but it will be understood that variations and modifications can be effected within the spirit and scope of the invention.

I Claim:

1. A bleach-accelerating composition that is useful in color reversal photographic processing, said composition comprising a bleach-accelerating agent and, as a scum-preventing agent, an ethyleneoxy-substituted fatty acid ester of sorbitan.

2. A bleach-accelerating composition as claimed in claim 1 wherein said ester has a hydrophile-lipophile balance value of at least about fifteen.

3. A bleach-accelerating composition as claimed in claim 1 wherein said ester is a monoester.

4. A bleach-accelerating composition as claimed in claim 1 wherein said ester is a monoester of lauric, palmitic or oleic acids.

5. A bleach-accelerating composition as claimed in claim 1 wherein said bleach-accelerating agent is a sulfur-containing organic compound.

6. A bleach-accelerating composition as claimed in claim 1 wherein said bleach-accelerating agent is an aliphatic thiol.

7. A bleach-accelerating composition as claimed in claim 1 wherein said bleach-accelerating agent is monothioglycerol.

8. An aqueous acidic bleach-accelerating bath that is useful in color reversal photographic processing, said bath containing a bleach-accelerating amount of an aliphatic thiol and a scum-preventing amount of an ethyleneoxy-substituted lauric, palmitic or oleic ester of sorbitan.

9. An aqueous acidic bleach-accelerating bath that is useful in color reversal photographic processing, said bath containing a bleach-accelerating amount of monothiogylcerol and a scum-preventing amount of an ethyleneoxy-substituted sorbitan monolaurate.

10. A method for processing a silver halide color photographic element including, in succession, the steps of color developing, conditioning and bleaching, wherein said conditioning step is carried out with a composition comprising a bleach-accelerating agent and, as a scum-preventing agent, an ethyleneoxy-substituted fatty acid ester of sorbitan.

11. A method as claimed in claim 10 wherein said ester has a hydrophole-lipophile balance value of at least about fifteen.

12. A method as claimed in claim 10 wherein said ester is a monoester.

13. A method as claimed in claim 10 wherein said ester is a monoester of lauric, palmitic or oleic acid.

14. A method as claimed in claim 10 wherein said bleach-accelerating agent is a sulfur-containing organic compound.

15. A method as claimed in claim 10 wherein said bleach-accelerating agent is an aliphatic thiol.

16. A method as claimed in claim 10 wherein said bleach-accelerating agent is monothioglycerol.

17. A method as claimed in claim 10 wherein said photographic element comprises an antistatic layer containing a highly cross-linked vinylbenzyl quaternary ammonium polymer in combination with a hydrophobic binder.

18. In a method of photographic color reversal processing in which a photographic element is subjected to the successive steps of color developing conditioning in a bath containing a bleach-accelerating agent, and bleaching; said element comprising an antistatic layer containing a highly cross-linked vinylbenzyl quaternary ammonium polymer in combination with a hydrophobic binder and being susceptible to formation in said conditioning bath of a layer of scum which forms on the surface of said antistatic layer, the improvement which comprises incorporating in said conditioning bath a scum-preventing amount of an ethyleneoxy-substituted fatty acid ester of sorbitan.

19. A method as claimed in claim 18 wherein said ester is an ethyleneoxy-substituted lauric, palmitic or oleic ester of sorbitan.

20. A method as claimed in claim 18 wherein said ester is an ethyleneoxy-substituted sorbitan monolaurate.

* * * * *